US009702627B2

(12) United States Patent
Wilson et al.

(10) Patent No.: US 9,702,627 B2
(45) Date of Patent: Jul. 11, 2017

(54) HIGH TEMPERATURE VACUUM FURNACE HEATER ELEMENT SUPPORT ASSEMBLY

(71) Applicants: Robert J. Wilson, Warrington, PA (US); Mark J. Hughes, Perkasie, PA (US)

(72) Inventors: Robert J. Wilson, Warrington, PA (US); Mark J. Hughes, Perkasie, PA (US)

(73) Assignee: William R. Jones, Telford, PA (US)

( * ) Notice: Subject to any disclaimer, the term of this patent is extended or adjusted under 35 U.S.C. 154(b) by 460 days.

(21) Appl. No.: 14/120,389

(22) Filed: May 16, 2014

(65) Prior Publication Data

US 2015/0334778 A1 Nov. 19, 2015

(51) Int. Cl.
*H05B 3/66* (2006.01)
*F27B 5/04* (2006.01)
(Continued)

(52) U.S. Cl.
CPC ..... *F27B 5/04* (2013.01); *F27D 7/06* (2013.01); *F27D 11/02* (2013.01); *H05B 3/66* (2013.01);
(Continued)

(58) Field of Classification Search
CPC ... F27D 11/02; F27D 7/06; F27D 7/02; F27D 2007/066; F27D 2099/0008; H05B 3/66; H05B 3/16; H05B 3/64; F27B 5/04
(Continued)

(56) References Cited

U.S. PATENT DOCUMENTS 4,259,538 A * 3/1981 Jones ..... H05B 3/66 373/112
4,321,415 A 3/1982 Christian et al.
(Continued)

*Primary Examiner* — Hung D Nguyen
(74) *Attorney, Agent, or Firm* — Aaron Nerenberg, Esq.

(57) ABSTRACT

An electrical insulating and heating element support assembly for a high temperature vacuum furnace having a threaded support rod for connecting a heating element to the insulated hot-zone support ring in an electrically non-connected position includes insulator sleeves and washers surrounding the rod in contact with a series of refractory metal washers which may include graphite and/or molybdenum as shielding liners used to protect electrical insulators from having electrical short path means due to deposition of conductive materials onto the non-conducting insulators, and the use of threaded nuts and bushings to anchor the rod and shielding arrangement within the furnace hot zone. The non-conducting insulators and washers are made from materials with high thermal and electrical resistance, such as preferably alumina or mullite, and radially surround the support rod and the heating element. The electrically non-connected shielding washers and nuts, and the rod can be made from graphite or molybdenum, and are designed to be easily disassembled in order to provide relatively easier maintenance service to the vacuum furnace. This design accomplishes the dual objective of supporting both the heating element and the high temperature insulation support ring while remaining electrically non-connected from the heating element. It also allows for variations in thickness of the furnace insulation and heating elements which is common for different furnace designs. This new stand-off assembly is designed to be easily disassembled in order to provide faster maintenance turnaround time and reuse of the stand-off hardware. Another equally important advantage of this design is the absence of holes in the support rod for the placement of pin retainers, and the elimination of the pin retainers, commonly found in prior art vacuum furnace heater element support assembly designs.

21 Claims, 3 Drawing Sheets

(51) Int. Cl.
*F27D 7/06* (2006.01)
*F27D 11/02* (2006.01)
*F27D 99/00* (2010.01)

(52) U.S. Cl.
CPC ..... *F27D 2007/066* (2013.01); *F27D 2099/0008* (2013.01)

(58) Field of Classification Search
USPC ..... 219/542, 544, 546, 548, 552, 553; 373/109, 117, 118, 119, 120, 123, 124, 373/125, 127, 128, 129, 130, 131, 132, 373/133, 134, 137
See application file for complete search history.

(56) References Cited

U.S. PATENT DOCUMENTS 4,425,660 A 1/1984 Jones
4,559,631 A 12/1985 Moller
4,612,651 A * 9/1986 Moller ..... H05B 3/66 373/110
4,860,306 A * 8/1989 Gibb ..... H05B 3/66 373/112
5,282,221 A 1/1994 Benedict et al.
5,502,742 A * 3/1996 Kellogg ..... F27B 5/16 239/597
5,930,285 A 7/1999 Moller
6,021,155 A 2/2000 Jones
6,023,487 A 2/2000 Jones
6,111,908 A * 8/2000 Jones ..... H05B 3/66 373/128
6,936,792 B2 8/2005 Jones
7,514,035 B2 4/2009 Jones
8,088,328 B2 1/2012 Jones
2007/0214834 A1* 9/2007 Roeper ..... C03B 19/1453 65/17.3
2007/0215306 A1* 9/2007 Muramatsu ..... B22D 17/12 164/113
2009/0035948 A1* 2/2009 Miyata ..... H01L 21/67109 438/778

* cited by examiner

HIGH TEMPERATURE VACUUM FURNACE HEATER ELEMENT SUPPORT ASSEMBLY

FIELD OF THE INVENTION

This invention relates to high temperature heat treating furnaces that employ electric resistance heating elements, and in particular, to an improved support assembly for suspending such elements including improved shielding devices utilizing electrically non-conducting and conducting materials designed to be easily disassembled in order to provide maintenance service to the vacuum furnace for different heat treating applications.

BACKGROUND OF THE INVENTION

Vacuum heat treating furnaces utilizing electrical heating elements are well known in the art. A typical vacuum heat treating furnace includes a furnace wall and a hot zone chamber of circular cross-section which houses a series of banks of axially-spaced electrical resistance heating elements suspended from an inner wall of the hot zone chamber by a series of support rods attached to the outer wall of the backing ring through the insulation/radiation shields into the heating elements. A heating element is generally manufactured from graphite, molybdenum or other conducting materials, and generates radiant heat in response to the passage of electrical current therethrough. Typical examples of such furnace support rod designs can be seen in U.S. Pat. Nos. 4,259,538; 4,425,660; 4,559,631; 5,930,285; 6,021,155; 6,023,487; 6,111,908; 6,936,792; 7,514,035; and 8,088,328.

A typical design of the support rods includes electrical insulating components such as ceramic washers or tubing necessary to separate the heating element from the portion of the support rod that is directly affixed to the furnace wall. One drawback with the use of ceramic insulators is the eventual contamination of the ceramic surface from metallic depositions, or metallization, due to outgassing of materials within the heated hot zone or material spilling on or dropping onto the support elements at the bottom of the furnace during processing. The eventual buildup of metal on the ceramic insulators leads to loss of their insulation properties and increased conduction between the heating element and the furnace wall, leading to short circuits and arcing, which can result in furnace operation disruption and possible physical damage to the heating elements and work pieces in the furnace at the time of arcing.

Various support rod designs described in U.S. Pat. Nos. 6,111,908 and 5,930,285 address the use of different arrangements of fixturing within the rod support design to protect the ceramics from metallization. The problem of "short circuiting" between the mounting rods and the heating elements was fully described in U.S. Pat. No. 4,259,538 and further discussed in U.S. Pat. Nos. 5,930,285 and 6,111,908. Shielding by use of molybdenum shields or vaporization shields to prevent material build-up, or metallization, which causes the afore-mentioned short circuits, has also been fully explored in the prior art references, These designs have been used for many years, and not only do they still suffer regularly from metallization issues, but also from failures due to the actual physical design of the support rod itself.

In both prior art U.S. Pat. Nos. 4,259,538 and 6,111,908 the support rod is subjected to drilling for the placement of locking mechanisms to hold the washers and insulation tubing in place. The actual process of drilling three holes into the support rod not only becomes time consuming and costly, but it also provides three locations for stress failure within the rod and also failure of the fasteners inserted into the holes due to repeated heating and cooling during the lifetime of the furnace. These weaknesses lead to loss of stability and movement within the support assembly, and loss of insulating capacity, as the support rods and heating elements are exposed to electrical currents. The result of such fastener damage is short circuits which also lead to operation disruption and possible damaging arcing within the furnace while at high heat temperatures.

As fully described in prior art U.S. Pat. Nos. 4,425,660 and 6,111,908, the disclosures of both of which are incorporated in their entireties herein by reference, under the conditions of a high temperature heat treatment process with relatively long cycling times, a certain amount of molybdenum from moly elements or shields reacts with water vapor inherent in a vacuum furnace even at very high temperatures and leads to the formation of a gaseous $MoO_3$, which deposits on the adjacent ceramic insulators. During subsequent vacuum heat treat cycles, the $MoO_3$ is reduced leaving elemental Mo adhered to the ceramic washers, Subsequent heat treat cycles over time lead to a buildup of molybdenum film on the ceramic washers resulting in increased conductivity on these ceramic washers and loss of the insulation capability of these washers. The resultant conductive nature of these ceramic washers leads to short circuits, as the support rod and the heating element are no longer separated electrically.

The arrangement in U.S. Pat. No. 4,425,660 overcame this issue with the molybdenum shield by providing a pair of graphite shields to be used in lieu of the molybdenum shield. In another embodiment in this patent the graphite liners were secured to the sides of the molybdenum shields that faced the heating element. Other embodiments of the graphite protective liners are described in this patent. However, as described in U.S. Pat. No. 6,111,908, use of the design in U.S. Pat. No. 4,425,660 under long high temperature baking cycles and with alumina type washers, the improvements described in U.S. Pat. No. 4,425,660 shielding packages adequately protect the insulators from such destructive build-up of conductive materials. Other problems with the older: designs in U.S. Pat. No. 4,425,660, and addressed in U.S. Pat. No. 6,111,908, were also covered and described in U.S. Pat. Nos. 6,021,155 and 6,023,487, the disclosures of which are incorporated in their entireties herein by reference.

In the case of U.S. Pat. No. 6,111,908 the use of molybdenum shields was removed completely, and graphite cupped shields were used to protect the insulator means from metal deposition from either the molybdenum elements of from parts in the furnace during heat treating cycles. At the time of the invention described in U.S. Pat. No. 6,111,908 it was believed that at high temperature graphite did not have any reactivity toward the ceramic insulator. It has now been determined that at high temperature and in high vacuum, graphite abutting ceramic insulators can reduce the ceramic oxide, leading to loss of the ceramic material and providing a means to electrically connect the heating element and the rod support. This results in arcing and damage to the furnace.

The present invention addresses the weaknesses of prior art fastener support assemblies which lead to loss of fastener wire, and thus movement of ceramic washers and sleeves, thereby exposing the support rod to electrical contact with the heater element. It also provides a new and improved design which serves to reduce continued contamination of the ceramic washers. Key features of the present invention and weaknesses of the prior art designs are as follows: (1) the support rod is a single solid piece of molybdenum, carbon fiber composite (CFC) or graphite material; (2) the support rod contains no holes or cuts in the material; (3) the cost of manufacturing the support rods is significantly reduced due to elimination of drilling the holes; (4) the cost of using molybdenum wire or rod fasteners that easily become embrittled during repeated heating and cooling cycles is eliminated; (5) drilled holes are a set size, while heating element thickness can vary; the use of a solid rod eliminates the need to modify the standoff arrangement and standardizes the heater element support design to fit a variety of element designs of varied thicknesses; (6) the support rod is threaded on at least one end, or can be threaded on both ends or throughout, and is designed in such a way that a graphite threaded washer can be used to affix the support rod to the outside of the hot zone wall and to the inside heater element; a ceramic washer is used as a separator between the threaded graphite washer and the metal heater element surface; (7) use of graphite nuts in place of molybdenum nuts makes maintenance easier in that the natural lubricity of graphite prevents seizing of the nut and the rod, in which case the nut and rod would be destroyed and would have to be replaced.

SUMMARY OF THE INVENTION

The disadvantages associated with the prior art furnace heating element supports are resolved by an electrical insulating and support arrangement in accordance with the present invention. In a high temperature vacuum furnace system having a heating chamber with insulation and an area for placing work piece material for treatment, at least one wall, at least one heating element, at least one rod member to provide a base for securing the heating element in spaced relation to the wall, and an electrical insulating and support arrangement to be used with the rod member and the heating element, the support arrangement comprising:

a support rod threaded at least at one end thereof and electrically insulated from the heating element, bushing means in operative contact with said support rod at a second end thereof and in proximate contact with the furnace insulation structure for supporting the furnace insulation and the heating element, nut means formed to operatively engage the threaded end of said support rod, first annular insulator means passing through the heating element and surrounding said support rod adjacent to said nut means, first washer means operatively located between said first annular insulator means and said nut means, second annular insulator means surrounding said first annular insulator means and formed to be in operative contact with said first washer means on one end of said second annular insulator means, second washer means surrounding said heating element and adjacent to said second annular insulator means on one surface thereof and adjacent to said first washer means on another surface thereof, third washer means surrounding the heating element on each side thereof and formed to be adjacent to said second annular insulator means on the other end of said second annular insulator means, insulation retainer means surrounding said support rod and in operative contact with the furnace insulation, and annular sleeve means surrounding said support rod and in operative contact with said first washer means on one end thereof and with said insulation retainer means on another end thereof.

This configuration accomplishes the dual tasks of supporting both the heating element and the insulation in a high temperature vacuum furnace while remaining electrically insulated from the heating element. It allows the furnace to be easily and economically serviced with no replacement required for any of the support assembly elements. It further lowers the initial cost of manufacturing the elements necessary for this furnace configuration, as well as making replacement parts more readily available because of the elimination of drilling and machining the support rods, as required in the configurations disclosed in the prior art.

BRIEF DESCRIPTION OF THE DRAWINGS

The objects and features of the present invention will be better understood from the following description taken in conjunction with the drawings wherein.

DETAILED DESCRIPTION OF THE INVENTION

The present invention provides, in a preferred embodiment, an improved heating element support assembly in which the rod support design protects the ceramic components from "metallization." Prior art designs can be found in U.S. Pat. Nos. 8,088,328; 7,514,035; 6,936,792; 6,111,908; 6,023,487; 6,021,555; 5,930,285; 4,559,631; 4,425,660; and 4,259,538. The disclosure of each of these patents is incorporated herein in its entirety by reference.

Figure 1:
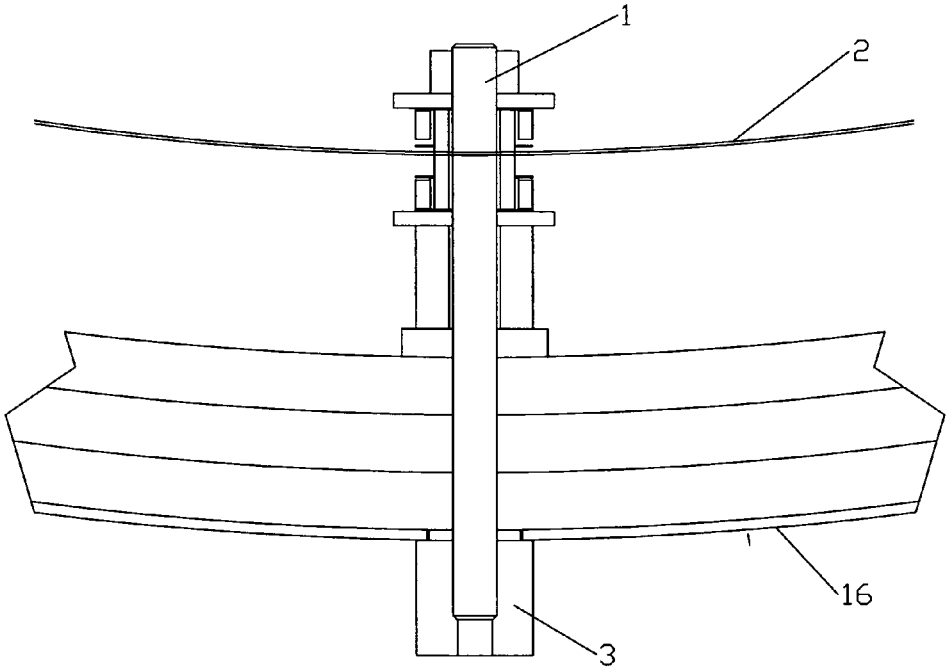
FIG. 1 depicts a cutaway section of a portion of a high temperature vacuum furnace illustrating a heating element support assembly that supports the heating element away from the furnace wall in accordance with the present invention.

Referring now to FIG. 1, there is shown a cutaway section of a high temperature vacuum furnace illustrating a support assembly that supports a heating element 2 away from the furnace wall 16. Heating element 2 is one of a plurality of heating elements within the hot zone chamber of the vacuum furnace that are electrically insulated from the furnace structure. The cylindrically shaped heating elements 2 are connected to the inner wall 16 of the hot zone chamber by a plurality of support rods 1 (preferably formed from relatively pure, commercially pure molybdenum, carbon fiber composite (CFC) or graphite material) which support each of the heating elements a distance away from the furnace wall 16. The support mechanism is anchored at the other end by bushing means 3. Bushing means 3 may be in the form of a full threaded nut made from preferably stainless steel, which is threaded onto the other end of support rod 1 to stabilize the support mechanism. Alternatively, bushing means 3 may be in the form of a nut with a twist lock design. In yet another embodiment of the present invention shown and more fully described in FIG. 3, for reduction of heat loss through the bushing, a modified bushing in the form of a nut with only a reduced annular portion welded to the outer wall 16 may be used. The furnace is generally formed in a substantially cylindrical shape having a substantially internal cross-section that is closed at its forward end by a releasable door (not shown).

In the embodiment illustrated in FIG. 1 the heating element bank is not formed into a complete loop, but has two ends at which an electrical power source is connected. If the banks of heating elements 2 were not electrically isolated from the support rods 1, and the mounting rods were connected to ground, a short circuit would occur which could cause damage to the furnace and also possibly to the work piece parts in the furnace. It is that type of major malfunction that the present invention eliminates.

Figure 2:
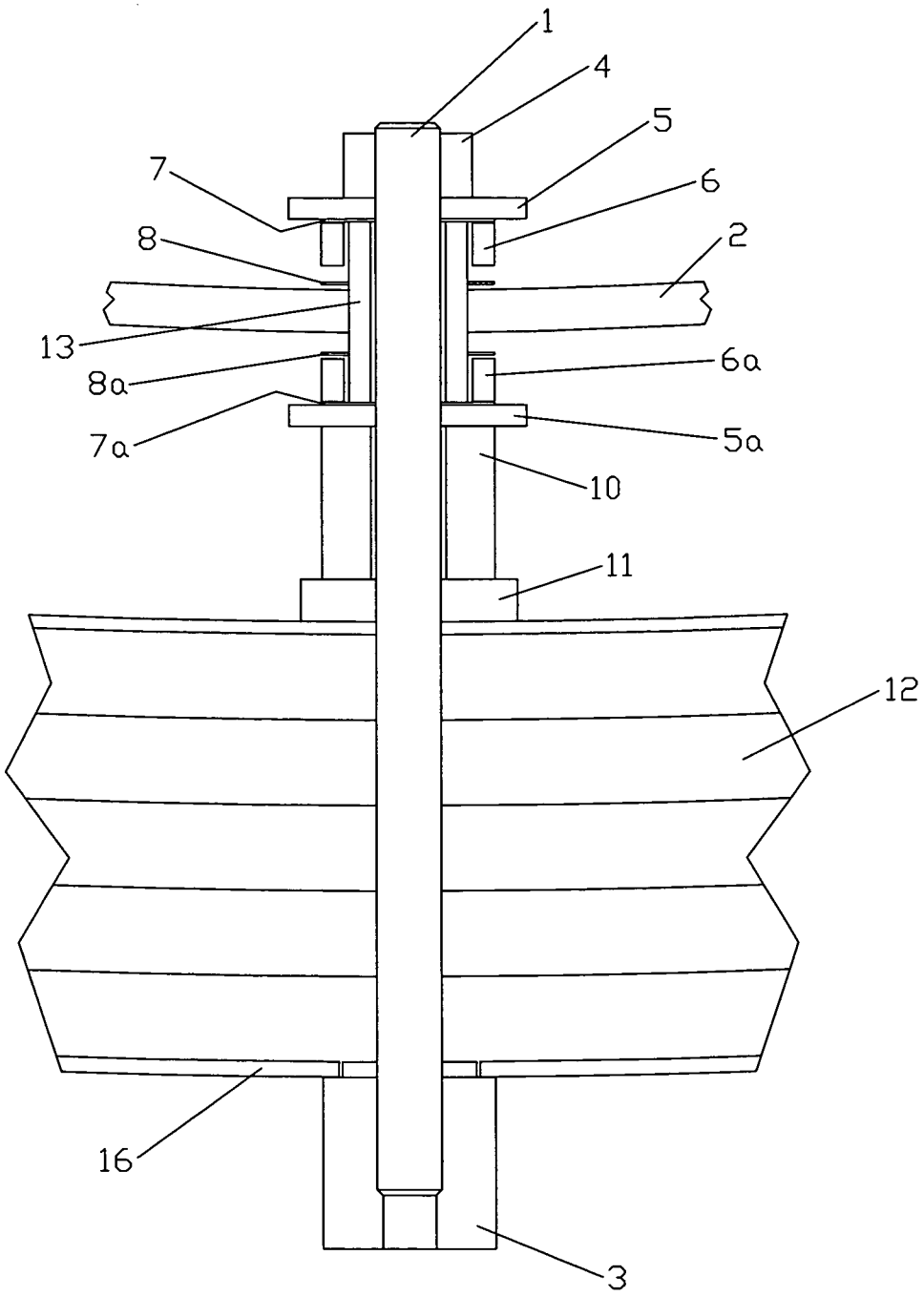
FIG. 2 depicts a dimensionally exaggerated cross-section of a heating element support assembly for supporting a heating element within a high temperature vacuum furnace including an electrically insulating assembly in accordance with a preferred embodiment of the present invention.

As shown in FIG. 2, an electrical insulating and support assembly for both heating elements and furnace insulation shields (or other refractory insulation materials) includes a support rod 1 which is threaded at least at one end thereof. Alternatively, rod 1 can be threaded throughout its length or at both ends. Rod 1 is preferably made from a material providing reasonable strength and thermal resistance such as preferably molybdenum. Rod 1 can alternatively be made from carbon fiber composite (CFC) or graphite material in certain instances. Rod 1 is supported by a bushing 3 which is preferably machined and is designed to be welded or bolted to the furnace insulation hot zone support ring assembly 16 so as to be rigid enough to support both a heating element 2 and furnace insulation 12. The design integrity relies primarily on a threaded nut 4 made from a material such as preferably graphite to retain the assembly, which in turn retains the support structure surrounding the furnace insulation 12. Heating element 2 is electrically insulated from the furnace by a plurality of insulators made from a material with high thermal and electrical resistance, such as preferably alumina or mullite. A central insulator 13 passes through heating element 2 and surrounds rod 1 providing electrical insulation between these two elements. A pair of insulators 6 and 6*a* surround central insulator 13 and are spaced in such a way that they allow radial thermal expansion of heating element 2 as it increases in temperature. This preserves both the heating element and the support structure for a longer service life due to reduction of stresses caused by thermal expansion. Insulators 6 and 6*a* are in near proximity to a pair of washers 8 and 8*a*, preferably flat washers, made of some refractory metal material such as preferably molybdenum, to prevent reaction of the alumina material onto insulators 6, 6*a* and 13. Washers 8 and 8*a* are located adjacent to both surfaces of heating element 2 at both its top and bottom. Insulators 6, 6*a* and 13 are in proximal contact at each of their respective ends with a pair of washers 5 and 5*a*, which are spaced from each other and surrounding rod 1. Washers 5 and 5*a* are preferably made from graphite material to shield the heating element 2 and the insulators 6, 6*a* and 13 from deposition of conductive material as well. A pair of washers 7 and 7*a* are in proximal contact with both ends of insulators 6 and 13 and with each of washers 5 and 5*a*. Washers 7, 7*a*, 8 and 8*a* are made from a refractory metal, such as preferably molybdenum, and they are located between graphite washers 5 and 5*a*, and ceramic sleeves 6 and 6*a*, in order to prevent abutment of the graphite and ceramic materials. This physical separation is required to prevent an unwanted detrimental chemical reduction process that can occur at high temperature and high vacuum, or in a hydrogen atmosphere, between graphite and alumina. This would result in evaporative loss of both graphite material and the ceramic washer material, thus leading to short circuiting and arcing. A sleeve 10 surrounds rod 1 between lower washer 5*a* and an insulation retainer 11 surrounding the furnace insulation. Sleeve 10 is made from a heat resistant material that is easily machined, such as preferably graphite. Sleeve 10 provides support for the insulation retainer 11, which in turn supports the furnace insulation.

The present design accomplishes the dual tasks of supporting both the heating element 2 and the furnace insulation 12 of a high temperature vacuum furnace while remaining electrically insulated from the heating element. The furnace is easily serviced by removing nut 4, which advantageously utilizes the self-lubricating properties of graphite and is not susceptible to crystallization like molybdenum, which was used in previous designs. A molybdenum nut would not be able to be removed after several heating cycles, but the graphite nut remains stable up to high temperatures above approximately 1600° F. Because the nut is easily removed for service, no parts such as molybdenum nuts or wires need to be broken in order to access the heating elements 2 for service or repair, making it very economical to periodically service the vacuum furnace. The present design also allows for variations in thickness of furnace insulation 12, which are sometimes necessary to accommodate different work pieces to be heat treated and varying cycle requirements. When adjusting the overall length of sleeve 10 to accommodate variations in insulation thickness, nut 4 can be adjusted to address changes in the thickness of insulation 12 over time or at initial installation. Another advantage of the present design is that no holes need to be drilled into rod 1 to accept a pin or wire retainer as in the previous design. This eliminates the costs of drilling and machining holes in rod 1, as well as of producing pin or wire retainers. Accordingly, replacement parts are less expensive and more readily available.

Figure 3:
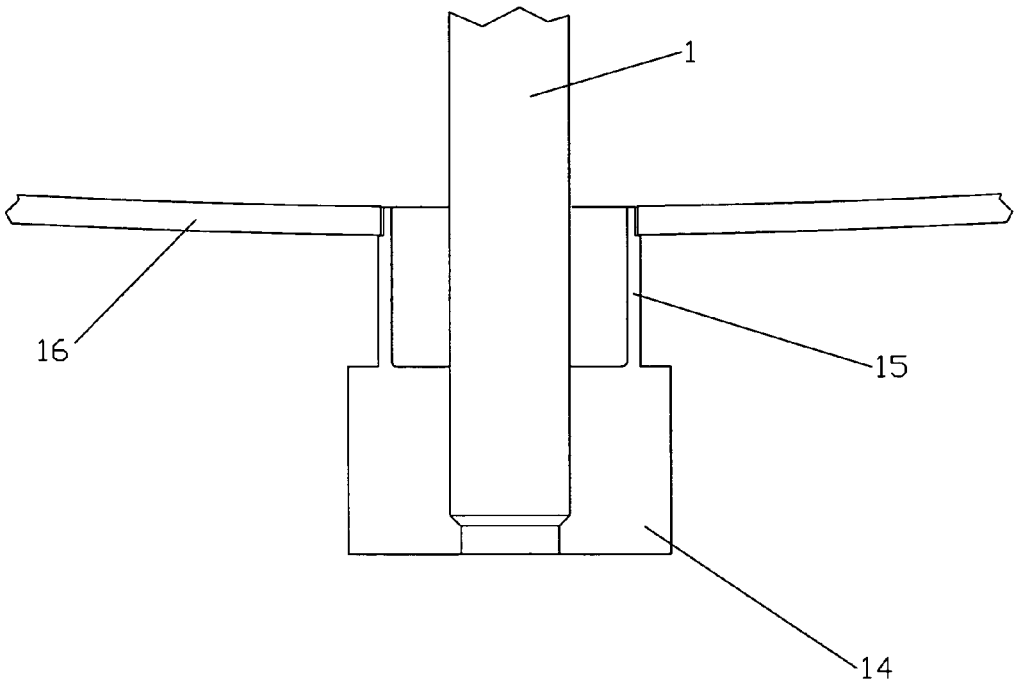
FIG. 3 depicts a dimensionally exaggerated cutaway cross-section of another embodiment of the present invention showing a portion of a heating element support assembly.

Referring now to FIG. 3, another embodiment of the present invention is shown in cross-section. This embodiment is identical to the embodiment illustrated in FIG. 2 and described hereinabove, with the exception of bushing means 14, which includes a reduced annular portion 15 in contact with support ring assembly 16. Annular portion 15 is machined as one piece from bushing means 14, and portion 15 is preferably approximately 0.040 inches in thickness. However, the range of thicknesses of annular portion 15 may be between 0.020 to 0.050 inches, in order to minimize the cross-sectional area of the heat conduction path between support ring assembly 16 and support rod 1. Annular portion 15 may be typically welded to support ring assembly 16. As described above with regard to bushing means 3, bushing means 14 may be in the form of a full threaded nut made from preferably stainless steel, which is threaded onto the other end of support rod 1 to stabilize the support mechanism. Alternatively, bushing means 3 may be in the form of a nut with a twist lock design.

The purpose of a reduced annular portion 15, as opposed to the full width or diameter of bushing 3 shown in FIG. 2 in contact with support ring assembly 16, is to reduce the amount of thermal heat transmission from the hot zone to bushing 14, and ultimately to support ring assembly 16. This configuration reduces energy transfer from the hot zone support ring assembly to the heat treating cold wall chamber, resulting in less power required to operate the furnace.

It will be recognized by those skilled in the art that changes or modifications can be made to the above-described invention without departing from the broad inventive concepts disclosed herein. It is understood, therefore, that the invention is not limited to the particular embodiments disclosed herein, but is intended to cover all modifications and changes that are within the scope of the invention as defined in the appended claims.

What is claimed is:

1. In a high temperature vacuum furnace system having a heating chamber with insulation material and insulation retaining plate, a hot zone area for placing work piece material for treatment, at least one hot zone support ring wall, at least one heating element, at least one support rod to provide a base for securing the heating element in spaced relation to the hot zone support ring wall, and an electrical insulating and support arrangement to be used with the support rod and the heating element, the support rod and support arrangement comprising: a solid support rod with no penetrations therein, said solid support rod being threaded at least at one end thereof and electrically insulated from the heating element, a threaded nut formed to operatively engage the threaded end of said solid support rod, bushing means in operative contact with said support rod at an opposite end thereof and in proximate contact with the hot zone support ring wall for supporting the furnace insulation material and the heating element, a central insulator passing through the heating element and surrounding said solid support rod adjacent to said threaded nut, a first pair of washers operatively located between said central insulator and said threaded nut, a second pair of insulators surrounding said central insulator and formed to be in operative contact with said first pair of washers on one respective end of each one of said second pair of insulators, a second pair of washers surrounding the heating element and adjacent to said second pair of insulators on one respective surface of each one of said second pair of washers and adjacent to said first pair of washers on another respective surface of each one of said second pair of washers, a third pair of washers surrounding the heating element on one respective surface of each one of said third pair of washers and formed to be adjacent to said second pair of insulators on another respective surface of each one of said third pair of washers, an insulation retaining plate surrounding said solid support rod and in operative contact with the furnace insulation, and an annular sleeve surrounding said solid support rod and in operative contact with one of said first pair of washers on one end thereof and with said insulation retainer plate on another end thereof.

2. A support arrangement in accordance with claim 1 wherein said second pair of insulators is not fastened to any surrounding parts.

3. A support arrangement in accordance with claim 1 wherein said second pair of insulators comprises a first portion and a second portion.

4. A support arrangement in accordance with claim 3 wherein a first portion of said second pair of insulators surrounds said central insulator on a first side of the heating element, and a second portion of said second pair of insulators surrounds said central insulator on a second side of the heating element.

5. A support arrangement in accordance with claim 1 wherein said solid support rod is comprised of molybdenum.

6. A support arrangement in accordance with claim 1 wherein said solid support rod is comprised of carbon fiber composite.

7. A support arrangement in accordance with claim 1 wherein said solid support rod is comprised of graphite.

8. A support arrangement in accordance with claim 1 wherein said threaded nut is comprised of graphite.

9. A support arrangement in accordance with claim 1 wherein said central insulator is comprised of alumina.

10. A support arrangement in accordance with claim 1 wherein said central insulator is comprised of mullite.

11. A support arrangement in accordance with claim 1 wherein said first pair of washers is comprised of graphite.

12. A support arrangement in accordance with claim 1 wherein said second pair of insulators is comprised of alumina.

13. A support arrangement in accordance with claim 1 wherein said second pair of insulators is comprised of mullite.

14. A support arrangement in accordance with claim 1 wherein said second pair of washers is comprised of molybdenum.

15. A support arrangement in accordance with claim 1 wherein said third pair of washers is comprised of molybdenum.

16. A support arrangement in accordance with claim 1 wherein said insulation retaining plate is comprised of graphite.

17. A support arrangement in accordance with claim 1 wherein said annular sleeve is comprised of graphite.

18. A support arrangement in accordance with claim 1 wherein said bushing means has a continuous surface in full contact with the vacuum furnace wall.

19. A support arrangement in accordance with claim 1 wherein said bushing means is in the form of a threaded nut and is formed to threadingly engage the opposite end of said solid support rod.

20. A support arrangement in accordance with claim 1 wherein said bushing means is in the form of a nut having a twist lock design and is formed to engage the opposite end of said solid support rod.

21. A support arrangement in accordance with claim 1 wherein said bushing means has an annular surface having a first cross-sectional diameter, and a second annular surface having a second cross-sectional diameter that is less than the first cross-sectional diameter.

* * * * *